US008530809B2

(12) United States Patent
Castor et al.

(10) Patent No.: US 8,530,809 B2
(45) Date of Patent: Sep. 10, 2013

(54) RING GEAR CONTROL ACTUATION SYSTEM FOR AIR-BREATHING ROCKET MOTORS

(75) Inventors: Matthew B. Castor, Tucson, AZ (US); John Fawcett Roden Bugge, Tucson, AZ (US); Jeffrey P. Sowers, Orlando, FL (US)

(73) Assignee: Raytheon Company, Waltham, MA (US)

( * ) Notice: Subject to any disclaimer, the term of this patent is extended or adjusted under 35 U.S.C. 154(b) by 233 days.

(21) Appl. No.: 13/197,512

(22) Filed: Aug. 3, 2011

(65) Prior Publication Data

US 2013/0032659 A1 Feb. 7, 2013

(51) Int. Cl.
*F42B 15/01* (2006.01)

(52) U.S. Cl.
USPC ..... 244/3.24; 244/3.21

(58) Field of Classification Search
USPC ..... 244/3.21, 3.24
See application file for complete search history.

(56) References Cited

U.S. PATENT DOCUMENTS

| | | | | |
|---|---|---|---|---|
| 4,291,533 | A | 9/1981 | Dugger et al. | |
| 4,327,885 | A | 5/1982 | Blevins et al. | |
| 4,327,886 | A | 5/1982 | Bell et al. | |
| 5,904,319 | A | 5/1999 | Hetzer | |
| 5,975,461 | A * | 11/1999 | Ullrich | 244/3.21 |
| 6,796,525 | B2 | 9/2004 | Johnsson et al. | |
| 7,765,885 | B2 | 8/2010 | Fjerstad | |

* cited by examiner

*Primary Examiner* — Timothy D Collins
*Assistant Examiner* — Nicholas McFall
(74) *Attorney, Agent, or Firm* — Eric A. Gifford

(57) ABSTRACT

A control actuation system for an air-breathing rocket motor propelled guided missile positions the drive motors and input gears in an inlet fairing extending aft of the air inlet towards the tail of the missile. The output gears are positioned coincident with and mechanically coupled to their respective tail fins spaced around the circumference of the missile. At least one of the tail fins is offset in a circumferential direction of the missile from its corresponding input gear and the inlet fairing. At least one ring gear is positioned around the exhaust tube to rotate in the circumferential direction of the missile. The ring gear comprises input and output teeth that engage the input and output gears, respectively, to actuate the tail fin.

20 Claims, 8 Drawing Sheets

RING GEAR CONTROL ACTUATION SYSTEM FOR AIR-BREATHING ROCKET MOTORS

BACKGROUND OF THE INVENTION

1. Field of the Invention

This invention relates to guided missiles with air-breathing rocket motors, and more particularly to a control actuation system (CAS) for manipulating tail fins to maneuver the guided missile.

2. Description of the Related Art

Flight vehicles such as self-propelled missiles, gun or tube launched guided projectiles, kinetic interceptors and unmanned aerial vehicles require command authority to maneuver the vehicle to perform guidance and attitude control. Each of these vehicles may operate over a speed range encompassing both subsonic and supersonic Mach numbers and within the atmosphere and exo-atmosphere during a single mission. The differing speed and atmospheric conditions present different problems for effectively maneuvering the vehicle under volume, weight and cost constraints imposed by the vehicle and mission.

One approach used in a majority of if not all missile products employs a Control Actuation System (CAS) for guidance to the target. Typically the CAS employs a set of four fin control surfaces actuated by individual motors. The motor drives an input gear train that actuates an output gear that is coupled to a radially oriented fin control surface. Actuation of the fin control surfaces into the onrushing free stream produces drag and directional forces to maneuver the vehicle. Control surfaces are effective at supersonic speeds above Mach 1 in an atmosphere where sufficient drag and force is produced to quickly maneuver the vehicle.

An air-to-air missile (AAM) is a guided missile fired from an aircraft for the purpose of destroying another aircraft. AAMs are typically powered by one or more rocket motors, usually solid fueled but sometimes liquid fueled. Air-breathing rocket motors such as a ramjet are emerging as propulsion systems that will enable medium-range missiles to maintain higher average speeds across their engagement envelopments and achieve higher ranges.

In a typical rocket motor, there exists sufficient volume in the annular region between the exhaust tube and the missile airframe to locate the CAS. Typically, four tail fins are oriented radially about the circumference of the missile and spaced 90 degrees apart. The CAS includes four direct actuation assemblies positioned in the annular region within the missile airframe under the fin. A rotary drive motor drives an input gear train that rotates the output gear on which the tail fin is mounted to pivot the fin about its axis.

In guided missiles with air-breathing rocket motors, and in particular ramjet engines, the exhaust tube is contracted only slightly from the diameter of the rocket motor and substantially fills the cross section of the missile airframe. Air-breathing rocket motors operate with relatively low operating pressures and thus require relatively large flow cross sections through the exhaust tube. Consequently, a conventional CAS cannot be located within the missile airframe.

U.S. Pat. No. 5,904,319 entitled "Guided Missile with Ram Jet Drive" describes a CAS for use with a guided missile with ram jet drive. The missile has two outer air intakes in the lower area of the airframe, which lead to the tail with wake shafts, with a tail plane including four separately pivotable vanes in the form of a diagonal cross. A rigid wing arrangement is provided in or in front of the center of the missile. One drive unit with linear movement is provided for each vane. Two of the drive units are arranged longitudinally offset in the longitudinal and circumferential directions of the guided missile in each wake shaft. A kinematic connection from the drive unit to the lower vane is formed by a coupling rod each with joints at both ends. A kinematic connection from the drive unit to the upper vane is formed by a pivotable double lever each and a coupling rod with ball joints at both ends. This configuration produces non-linear (non-constant) gear ratio to pivot the vanes (see col. 4, line 43).

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a CAS for an air-breathing rocket motor propelled guided missile.

This is accomplished by positioning the drive motors and input gears in an inlet fairing extending aft of the air inlet towards the tail of the missile. The output gears are positioned coincident with and mechanically coupled to their respective tail fins spaced around the circumference of the missile. At least one of the tail fins is offset in a circumferential direction of the missile from its corresponding input gear and the inlet fairing. At least one ring gear is positioned around the exhaust tube to rotate in the circumferential direction of the missile. The ring gear comprises input and output teeth that engage the input and output gears, respectively, to actuate the tail fin.

In an embodiment, the air-breathing rocket motor comprises a ramjet.

In an embodiment, the ring gear is part of a ring gear subassembly that also comprises bearings and a bearing housing that allow the ring gear to rotate in the circumferential direction of the missile around the exhaust tube. The ring gear is subjected to both axial and lateral forces that are not evenly distributed due to the locations of the input and output gears thereby producing a net moment on the ring gear. The subassembly may comprise a thrust bearing such as a needle bearing for axial forces and a pair of radial bearings for the lateral forces and moment.

In an embodiment, the guided missile comprises four tail fins and a single air inlet and inlet fairing. Two remote tail fins are offset in the circumferential direction of the missile from their corresponding input gears and the inlet fairing. The other two direct tail fins are offset in the circumferential direction from each other but coincident with the inlet fairing. The two remote tail fins are independently actuated by a pair of ring gears that mechanically couple the fins' respective input and output gears. The two direct tail fins are independently actuated by a direct coupling of their input and output gears. In an embodiment, the pair of ring gears face each other with all four output gears there between.

In an embodiment, the guided missile comprises four tail fins (two remote and two direct) and a pair of air inlets and inlet fairings. The drive motors and input gears from one remote and one direct tail fin are positioned within each of the inlet fairings. The two remote tail fins are independently actuated by a pair of ring gears that mechanically couple the fins' respective input and output gears. The two direct tail fins are independently actuated by a direct coupling of their input and output gears.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
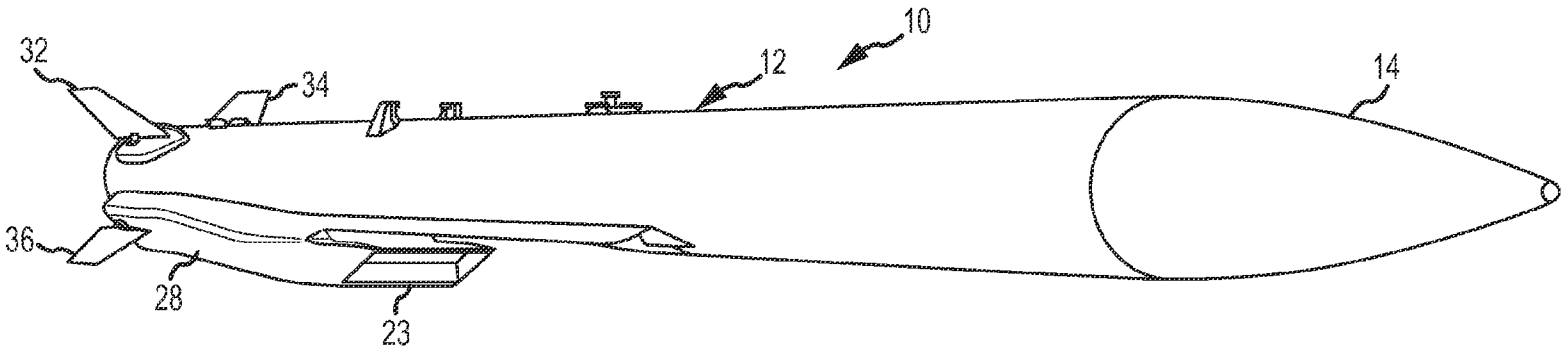
FIGS. 1*a* and 1*b* are a perspective view of an air-breathing rocket motor propelled guided missile provided with an embodiment of a ring gear CAS to manipulate the tail fins and a partial sectional view of the air inlet and its fairing and air-breathing rocket motor in accordance with the present invention.

The present invention describes a control actuation system (CAS) for an air-breathing rocket motor propelled guided missile. The CAS positions the drive motors and input gears in an inlet fairing extending aft of the air inlet towards the tail of the missile. The output gears are positioned coincident with and mechanically coupled to their respective tail fins spaced around the circumference of the missile. At least one of the tail fins is offset in a circumferential direction of the missile from its corresponding input gear and the inlet fairing. At least one ring gear is positioned around the exhaust tube to rotate in the circumferential direction of the missile. The ring gear comprises input and output teeth that engage the input and output gears, respectively, to actuate the tail fin.

The ring gear CAS may be configured for use with any air-breathing rocket motor propelled guided missile. A "missile" may be considered to encompass all varieties of air, ground or sea-launched missiles and short, medium or long-range missiles. The "missile" may be a self-propelled missile, gun or tube launched guided projectile, kinetic interceptors or unmanned aerial vehicles that require command authority to maneuver the airframe. The missile may have three or more, typically four tail fins, that pivot about a radial axis to maneuver the airframe at sub or supersonic speeds. The fins may be fixed in their deployed position to pivot or may deploy upon or shortly after launch.

The missile must use an air-breathing rocket motor for propulsion. An air-breathing rocket motor requires the intake of air for combustion of its fuel to produce hot exhaust gases that propel the missile. The air-breathing rocket motor may, for example, comprise a ramjet, scramjet, or turbojet. The rocket motor's exhaust tube will typically substantially occupy the cross section of the missile airframe. The missile comprises at least one air inlet with a streamlined inlet fairing extending aft towards the tail of the airframe. There are many different air inlet configurations that satisfy this criterion. The underslung two-dimensional and underslung axisymmetric are examples of single air inlet configurations. The twin two-dimensional and under wing axisymmetric are examples of dual air inlet configurations. The streamlined inlet fairing serves to provide a smooth transition from the trailing edge of the air inlet to the tail of the missile to reduce aerodynamic drag.

Without loss of generality, an embodiment of a ring gear CAS will be described for use with an air-breathing ramjet rocket motor propelled medium-range air-to-air missile with an underslung two-dimensional air inlet. A ramjet uses the forward motion of the missile to compress incoming air without the necessity of a separate compressor. Ramjets cannot produce thrust at zero airspeed and thus cannot move the missile from a standstill. A booster motor is suitably used to launch the missile and bring the missile up to speed. Ramjets require considerable forward speed to operate well, and as a class work most efficiently at speeds around Mach 3 and can operate to speeds of Mach 6. Ramjets are particularly useful in applications requiring a small and simple engine for high speed such as air-to-air missiles. There are many different types of ramjets including solid fuel ramjets, liquid fuel ramjets and ducted rockets.

Figure 1B:
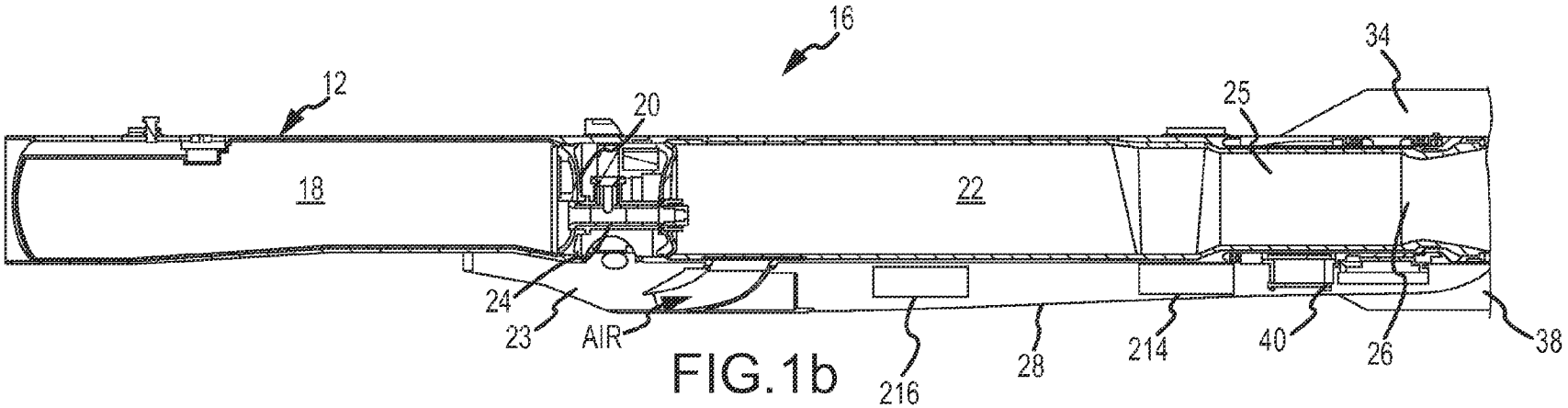

An air-breathing guided missile 10 with a ramjet engine is shown in FIGS. 1*a* and 1*b*. The missile airframe 12 has a largely cylindrical shape. A nose cone 14 forward of airframe 12 has a generally ogive shape for aerodynamics. A seeker and a guidance system are located in the nose cone and forward section of airframe 12. A warhead (e.g. explosive or kinetic rod) is typically located in airframe 12 aft of the guidance system.

A ramjet 16 is positioned aft of the warhead in airframe 12. In this embodiment, ramjet 16 is a variable-flow ducted rocket that comprises solid fuel 18 containing both a fuel and an oxidizer. An igniter 20 starts the solid fuel burning to produce a fuel-rich mixture that is injected into a combustion chamber 22 through a throttle valve 24 that controls the air/fuel mixture. An underslung two-dimensional air inlet 23 draws air into the combustion chamber and, together with the incoming fuel, combusts to produce a stream of hot gases that is expelled through an exhaust tube 25 and a ramjet nozzle 26 to expand to atmospheric pressure to produce a high velocity jet to propel the missile. A streamlined inlet fairing 28 extends aft from the trailing edge of air inlet 23 to the tail of the missile to improve aerodynamic performance.

For the ramjet, the exhaust tube 25 is contracted only slightly from the diameter of the rocket motor and substantially fills the cross section of the missile airframe 12. Ramjets operate with relatively low operating pressures and thus require relatively large flow cross sections through the exhaust tube. For example, a missile airframe with a 7" diameter may be fitted with an exhaust tube having a 6" diameter leaving only ½" of spacing between the exhaust tube and the airframe defining an annular volume.

Because the ramjet cannot operate at zero airspeed, the missile is provided with a booster rocket. In this missile configuration, the combustion chamber 22 is filled with a solid booster propellant and an ejectable booster nozzle is mounted inside the ramjet nozzle 26 as best shown in FIG. 5*b*. At launch, an igniter ignites the solid booster propellant to produce thrust that propels the missile up to speed. At the end of the boost phase, the combustion chamber 22 is empty and the booster nozzle is jettisoned.

Four tail fins 32, 34, 36 and 38 are spaced circumferentially about the missile and extend radially therefrom. Each tail fin can pivot independently about a radial axis. Tails fins 32 and 34 are offset in a circumferential direction of the missile from inlet fairing 28 (e.g. inlet fairing 28 occupies a lower section of the missile airframe and fins 32 and 34 occupy an upper section of the airframe). Tail fins 36 and 38 are coincident with inlet fairing 28 (e.g. both the inlet fairing 28 and tail fins 36 and 38 occupy the lower section of the airframe). In this embodiment, for storage in a launch bay fins 36 and 38 are shortened so that their total length from the airframe matches fins 32 and 34.

A ring gear CAS 40 is positioned around exhaust tube 25 in the small annular volume and within the volume of inlet fairing 28. CAS 40 includes four actuation assemblies to independently actuate the four tail fins 32, 34, 36 and 38. Two assemblies are "remote" actuation assemblies that remotely actuate tail fins 32 and 34 on the other side of the missile from the inlet fairing. The other two assemblies are "direct" actuation assemblies that directly actuate tail fins 36 and 38 located with the inlet fairing. CAS 40 also comprises electronics 214, batteries 216 and wiring harnesses (for connection to the missile guidance system).

CAS 40 is suitably a standalone unit that slides over exhaust tube 25 and is secured (e.g. bolted) to the rocket motor. Ramjet nozzle 26 is threaded onto exhaust tube 25. The CAS' wiring harnesses are connected to like missile wiring harnesses to establish communication between the missile and CAS. Inlet fairing 28 is secured in place over the CAS components and fins 32, 34, 36 and 38 are mounted onto the CAS.

Figure 2A:
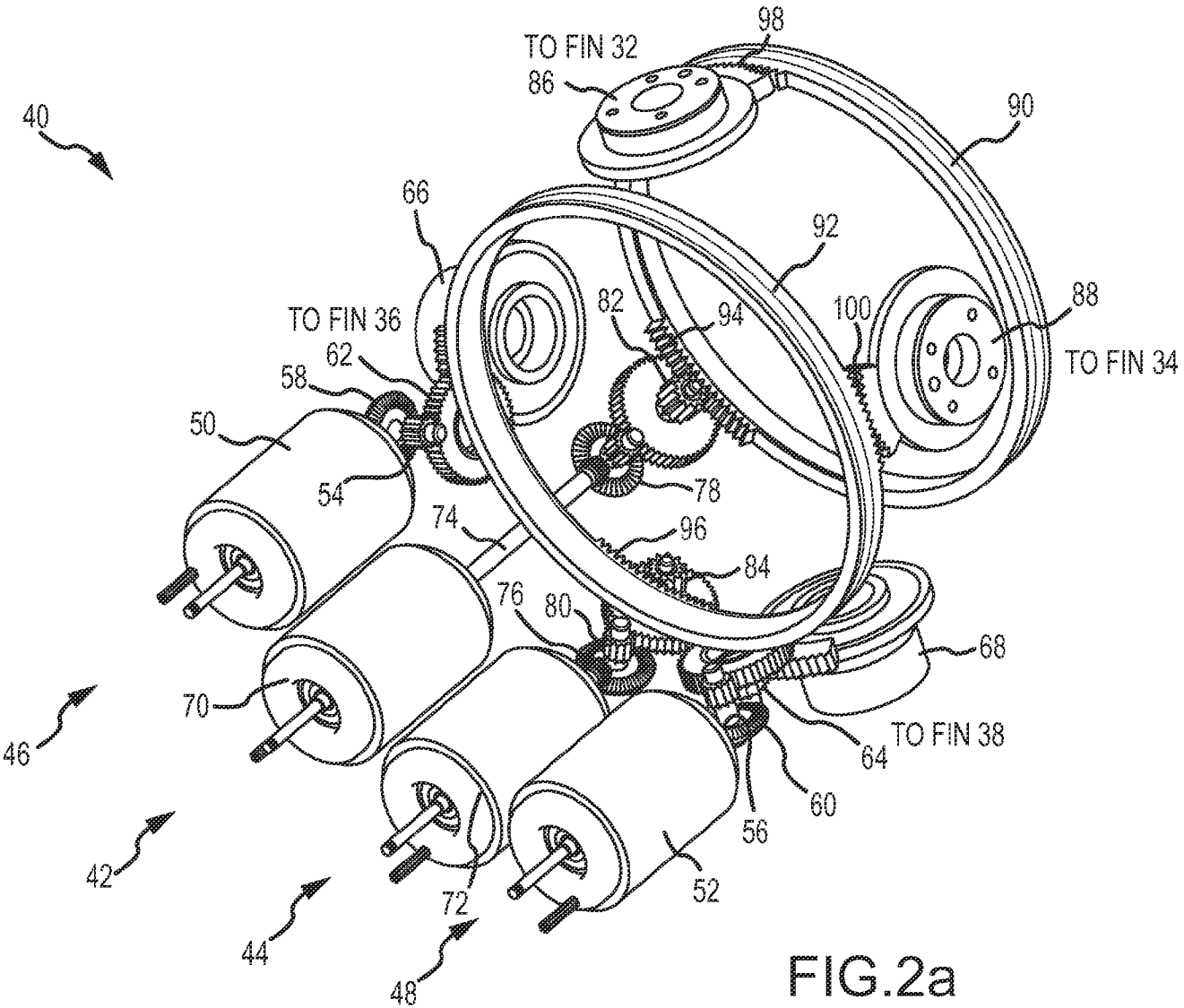
FIGS. 2*a* and 2*b* are diagrams of an embodiment of the drive motor and gear mechanisms of the ring gear CAS.
Figure 2B:
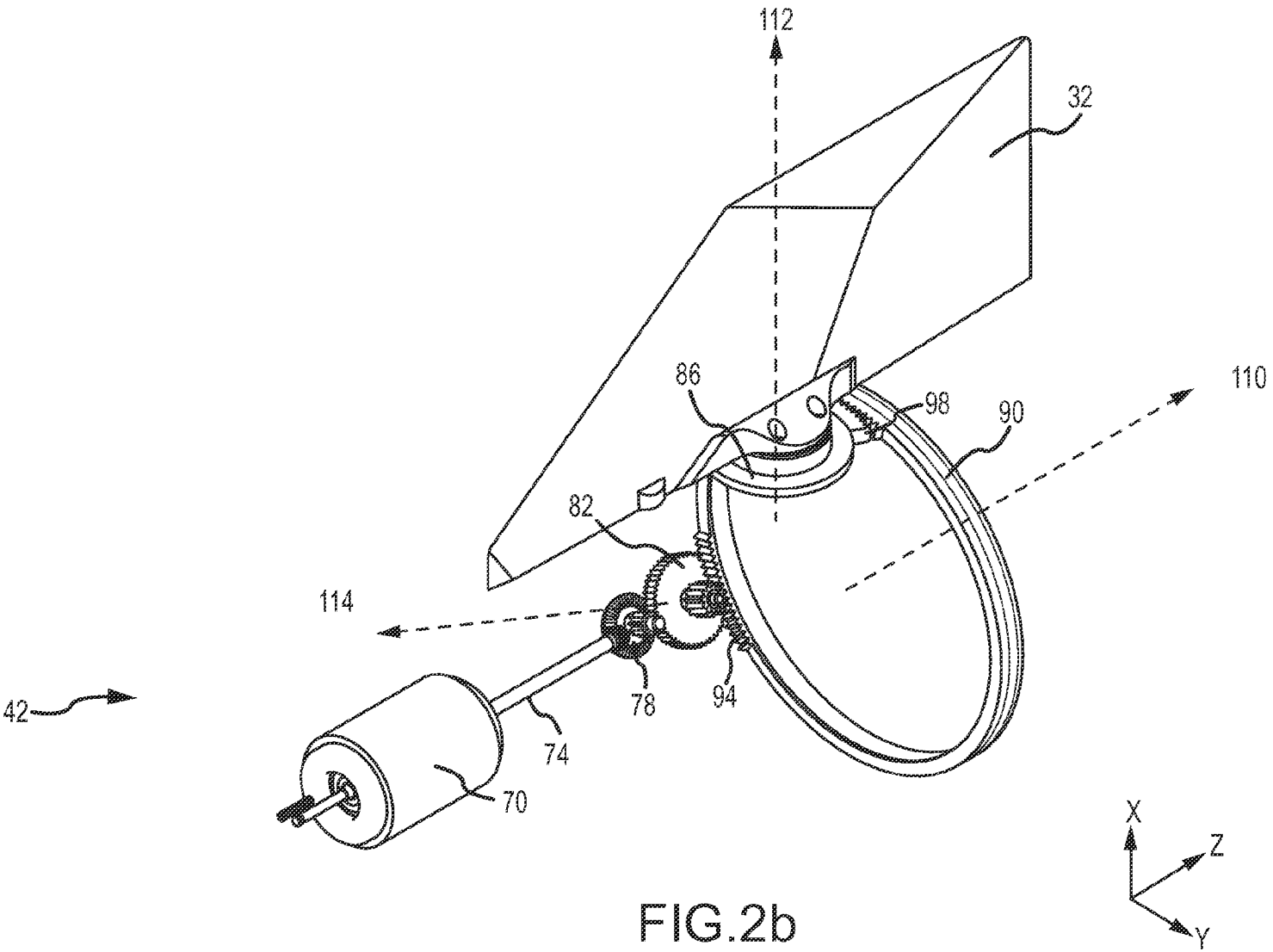

As depicted in FIGS. 2*a* and 2*b*, in an embodiment for the underslung two-dimensional inlet fairing CAS 40 includes four actuation assemblies 42, 44, 46 and 48 to independently actuate the four tail fins 32, 34, 36 and 38 (not shown), respectively. Assemblies 42 and 44 are "remote" actuation assemblies that remotely actuate tail fins 32 and 34 on the other side of the missile. Assemblies 46 and 48 are "direct" actuation assemblies that directly actuate tail fins 36 and 38 located with the inlet fairing.

Direct actuation assemblies 46 and 48 each comprise a drive motor (50 and 52) that rotates a drive shaft (54 and 56) to turn an input gear train (58 and 60). As shown, the drive motors are positioned axially. The drive motors may be positioned radially although this may require smaller diameter, less efficient drive motors. The input gear train comprises one or more compound gears (i.e. a large diameter gear attached to a small diameter gear) to increase the gear ratio. The input gear train mechanically couples the drive shaft to an input gear (62 and 64) to rotate the input gear about an input axis. As shown, the input axis is oriented radially. The input gear may or may not be part of one of the aforementioned compound gears. An output gear (66 and 68) engages the input gear (62 and 64) to rotate about a radial axis and actuate the fins (36 and 38 not shown). When the CAS is secured to the missile, all of the direct actuation assembly components are external to the exhaust tube and lie within the interior volume of the inlet fairing with the exception of the output gear that extends through the fairing along a radial axis to the missile to actuate the fin.

Remote actuation assemblies 42 and 44 each comprise a drive motor (70 and 72) that rotates a drive shaft (74 and 76) to turn an input gear train (78 and 80). As shown, the drive motors are positioned axially. The drive motors may be positioned radially although this may require smaller diameter, less efficient drive motors. The input gear train comprises one or more compound gears (i.e. a large diameter gear attached to a small diameter gear) to increase the gear ratio. The input gear train mechanically couples the drive shaft to an input gear (82 and 84) to rotate the input gear about an input axis. As shown, the input axis is oriented radially. The input gear may or may not be part of one of the aforementioned compound gears. The input gear could be rotated 90° to orient its input axis axially. An output gear (86 and 88) is positioned coincident with and mechanically coupled to rotate the tail fin (32 and 34) about a radial axis. The output gear is offset in a circumferential direction from the input gear (82 and 84). A ring gear (90 and 92) is positioned axially to rotate in the circumferential direction. The gear comprises input teeth (94 and 96) that engage the input gear (82 and 84) and output teeth (98 and 100) that engage the output gear (86 and 88) to rotate the output gear and remotely actuate the tail fin (32 and 34 not shown). In general, the input teeth and output teeth have a different geometry to engage the different sized input and output gears. The teeth may, for example, comprise face teeth, spur teeth, or bevel teeth (which are mirrored by the input and output gears). In this embodiment, ring gears 90 and 92 each have two sectors of face teeth and are positioned with their teeth facing each other so that the four output gears and their fins can lie in a plane orthogonal to the missile between the two ring gears.

When the CAS is secured to the missile, all of the remote actuation assembly components are external to the exhaust tube. The drive motor, input gear train and input gear lie within the interior volume of the inlet fairing. The output gear and its fin are offset in the circumferential direction of the missile from the inlet fairing. The ring gear lies both within and external to the inlet fairing, which allows the ring gear to affect remote actuation of the fin.

In an alternate embodiment, minor modifications can be made to the ring gear CAS to accommodate an air-breathing rocket motor that has a pair of air inlets and inlet fairings such as a twin two-dimensional intake. For example, a direct and a remote actuation assembly can be paired and positioned within one of inlet fairings. The direct actuation assembly would actuate a fin coincident with (and extending from) that inlet fairing. The remote actuation assembly would actuate a fin offset in a circumferential direction of the missile from that inlet fairing. Furthermore, the ring gear CAS may be reconfigured for use with various combinations of one or more air inlets and inlet fairings and three or more fins positioned circumferentially about the missile as long as one of the fins is offset in the circumferential direction of the missile from an inlet fairing.

As shown in FIG. 2*b*, in remote actuation assembly 42 ring gear 90 rotates about a ring axis 110. Output gear 86 and fin 32 are positioned to rotate about an output axis 112 that is radial with respect to ring axis 110. Drive motor 70 is positioned axially with respect to a ring axis 110, offset by in the axial direction. Drive motor 70 rotates drive shaft 74 to turn the compound gears of input gear train 78, which in turn rotate input gear 82 about an input axis 114 that is radial with respect to ring axis 110. Rotation of input gear 82 engages input teeth 94 on ring gear 90 causing the ring gear to rotate in a circumferential direction about ring axis 110. Rotation of the ring gear 90 displaces output teeth 98 in a circumferential direction engaging output gear 86 and causing the output gear and fin 32 to rotate about output axis 112.

The ring gear CAS and particularly the remote actuation assembly will both fit into the limited annular space available around the exhaust tube and the volume provided by the inlet fairing and provides the performance required by a supersonic missile. The ring gear is an idler gear and as such its geometry does not affect the overall gear ratio. However, the gear ratio at the ring gear is higher than the overall gear ratio (over twice as high in this embodiment). Therefore, the ring gear is characterized by low equivalent friction and low equivalent inertia when measured at the drive shaft, due to the relatively high gear ratio at the ring gear. The gear design of the CAS also provides a high stiffness throughout the gear train to actuate the fins. The gear design provides a constant gear ratio over a range of motion of the fin.

Figure 3:
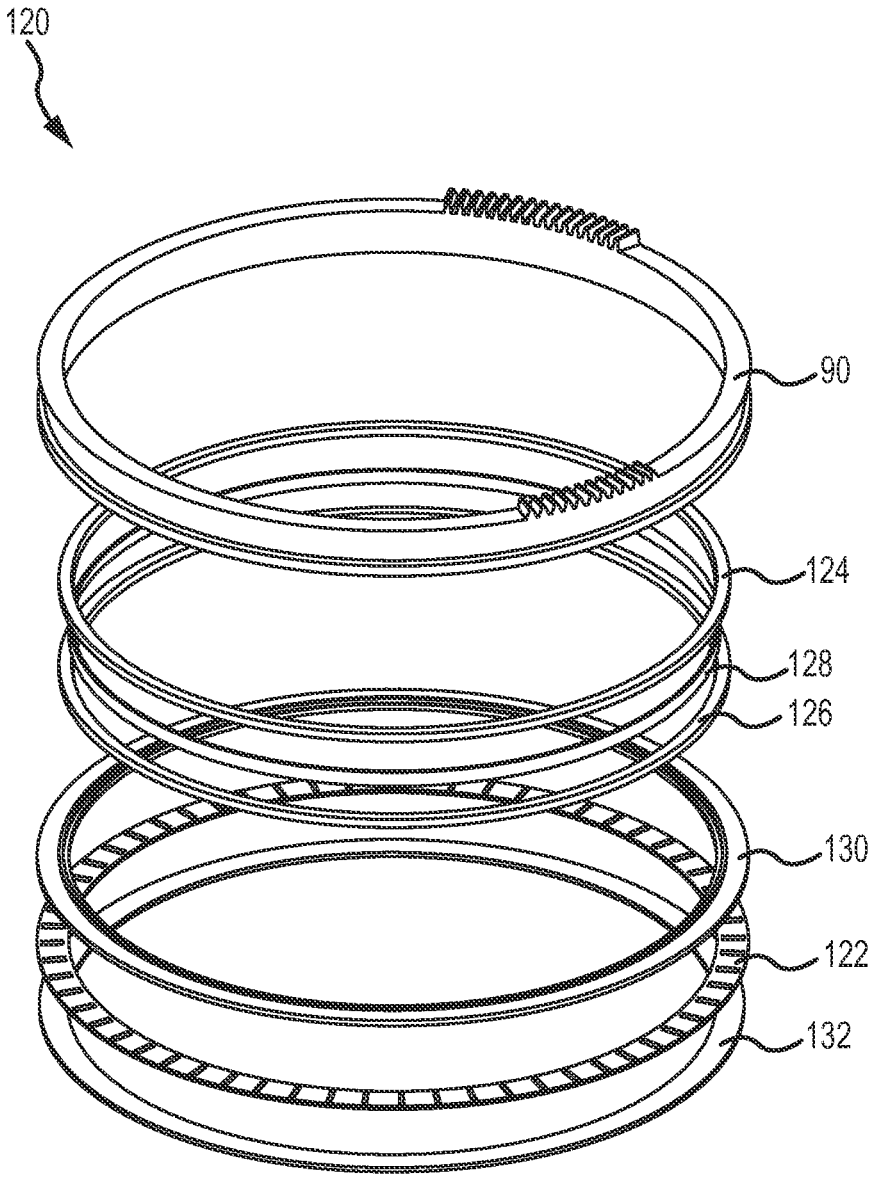
FIG. 3 is an exploded view of an embodiment of a ring gear assembly.

An embodiment of a ring gear assembly 120 of which ring gear 90 is a part is illustrated in FIG. 3. Rolling elements such as needle, ball or roller bearings support loads from both the input and output gear teeth allowing the ring gear to rotate with low friction. Forces on the ring gear are in both the axial and the lateral directions. Due to the locations of the two mating gears the forces are not evenly distributed which produces a net moment on the ring gear. In this embodiment, the assembly uses a thrust bearing 122 to address the axial forces and a pair of radial bearings 124, 126 to address the lateral forces and moment. Radial bearings 124 and 126 separated by a bearing spacer 128 are placed into an annular ring on the backside of ring gear 90. This subassembly is inserted into a bearing housing (not shown). Thrust bearing 122 is placed between a pair of races 130, 132 and held in place by the bearing housing. Thrust bearing 122 may comprise needle or roller bearings. A race is a hardened steel ring designed to support the loads of rolling elements. It will be apparent to one of ordinary skill in the art that there are many different configurations for assembling rolling element bearings to support low friction rotation of ring gear 90. Some bearing types will support axial, lateral and moment loads.

Figure 4A:
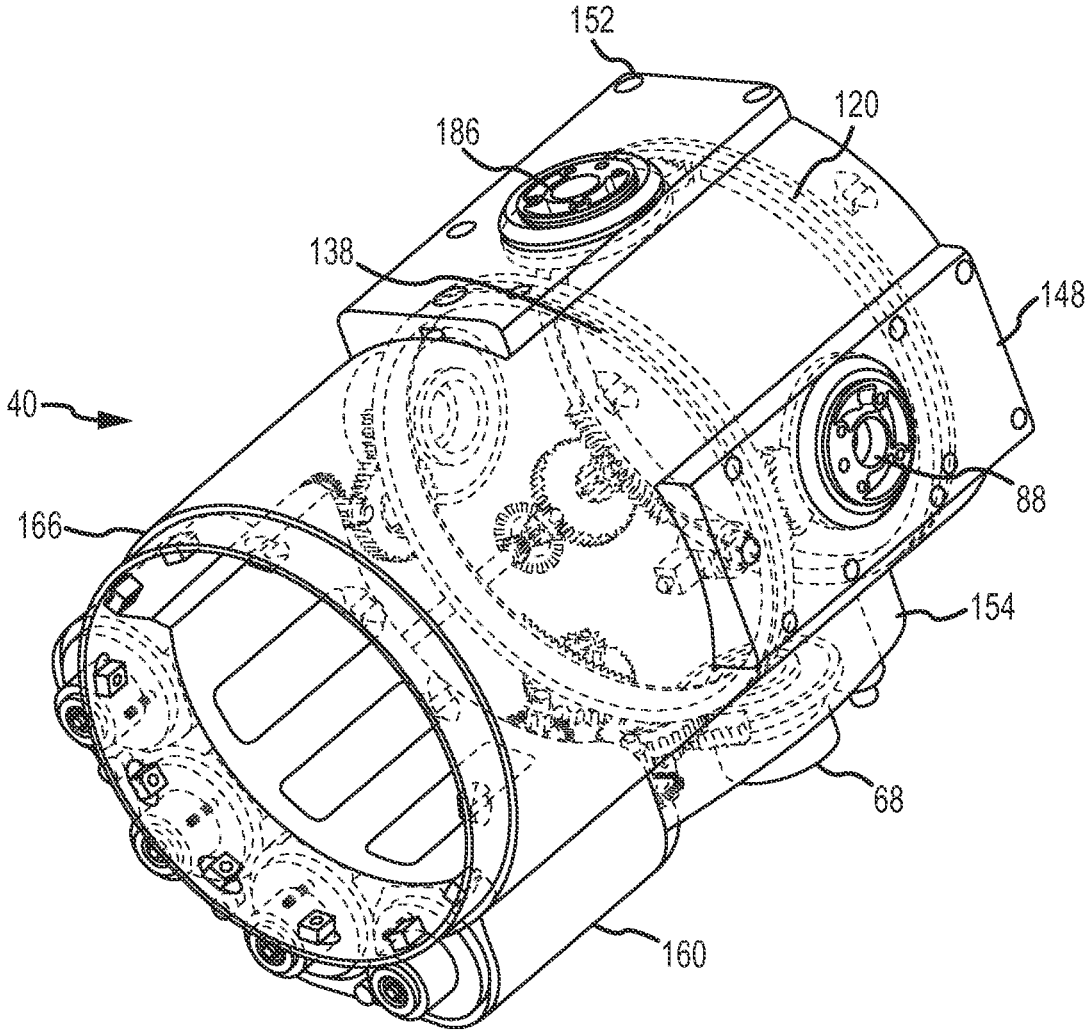
FIGS. 4*a* and 4*b* are a transparent and exploded view, respectively, of the ring gear CAS.
Figure 4B:
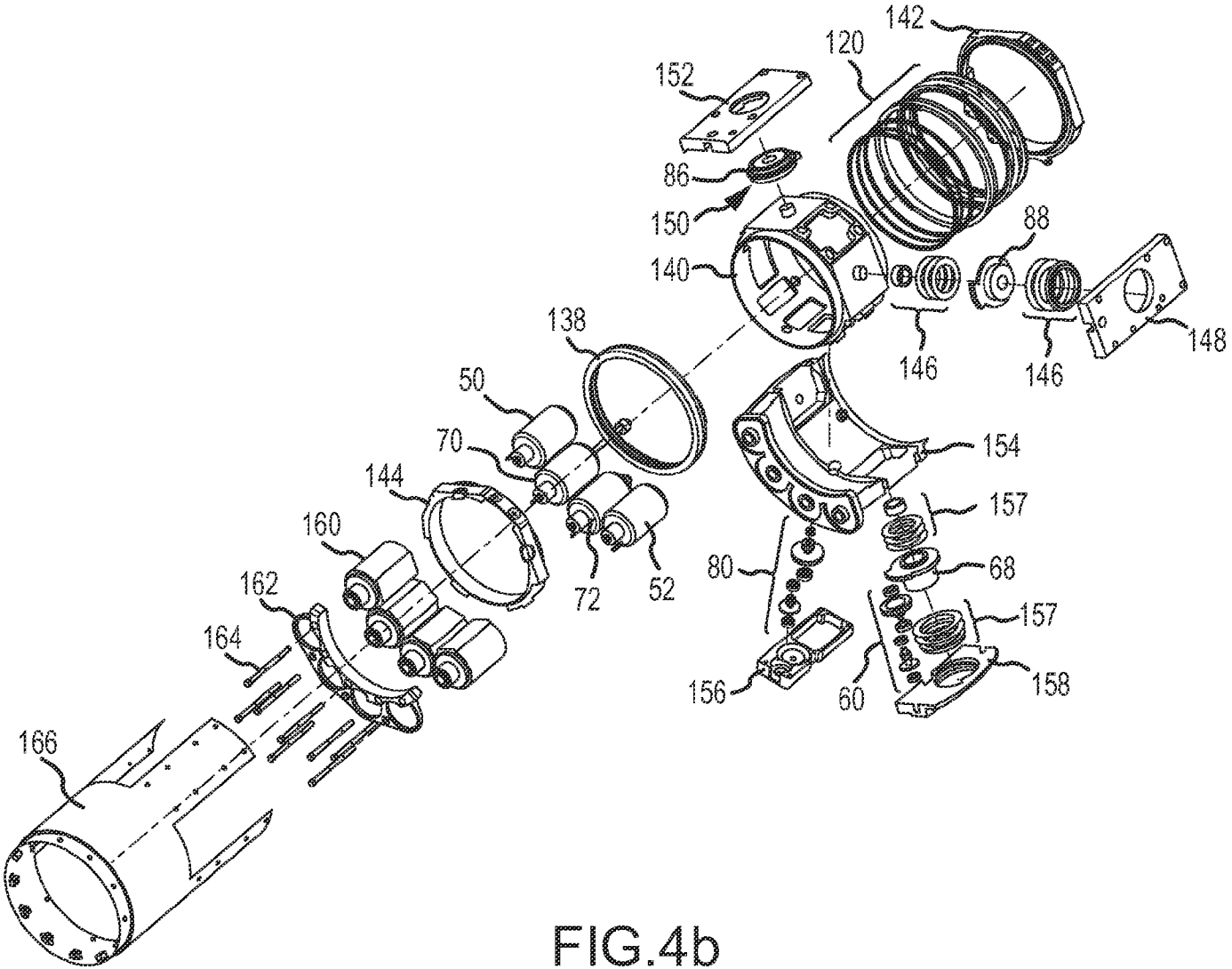

FIGS. 4*a* and 4*b* illustrate assembled and exploded views of an embodiment of ring gear CAS 40 sans the electronics, batteries and wiring harnesses. As mentioned previously, the CAS is a separate unit the slides over the tail of the missile, is bolted to the rocket motor and connected to the missile electronics through its wiring harness.

To assemble CAS 40 from its parts, ring gear assemblies 120 and 138 are slid over a main housing 140 from opposing ends. Aft housing 142 is attached to main housing 140 to secure ring gear assembly 120. Forward housing 144 is attached to the other side of main housing to secure ring gear assembly 138. Remote output gear 88 and its bearings 146 are mounted to main housing 140. A remote thrust plate 148 is placed over output gear 88 and bolted to the main housing, forward housing and aft housing. The process is repeated for remote output gear 86, bearings 150, and remote thrust plate 152.

A gear housing 154 is attached to the main housing, forward housing, and aft housing. For the two remote assemblies, first and second stage compound gears and their bearings that make up the input gear trains (78 or 80) and input gears (82 and 84) are installed into the gear housing. Intermediate thrust plates 156 are placed over the compound gear stages and bolted to the gear housing. For the two direct assemblies, the first and second stage compound gears that make up the input gear trains (60), input gears (64) and output gears (68) and their associated bearings 157 are installed into the gear housing. Direct thrust plates 158 are placed over the direct gear trains and bolted to the gear housing.

The drive motors 50, 70, 72, and 52 are first separated into motor rotor and motor stator. The drive shaft bearings and motor rotor are assembled onto their respective drive shafts. The four motor drive shaft assemblies are installed into gear housing 154. Motor stators are installed over the drive shaft assemblies until end of motor stators contact gear housing. One or more motor housings 160 are placed over the drive motor/shaft assemblies. A forward plate 162 is placed over motor housings 160 and attached with bolts 164 through motor housings to gear housing 154. A metal skin 166 is placed over the entire assembly and bolted to main housing 140, forward housing 144, aft housing 142, and forward plate 162.

Figure 5A:
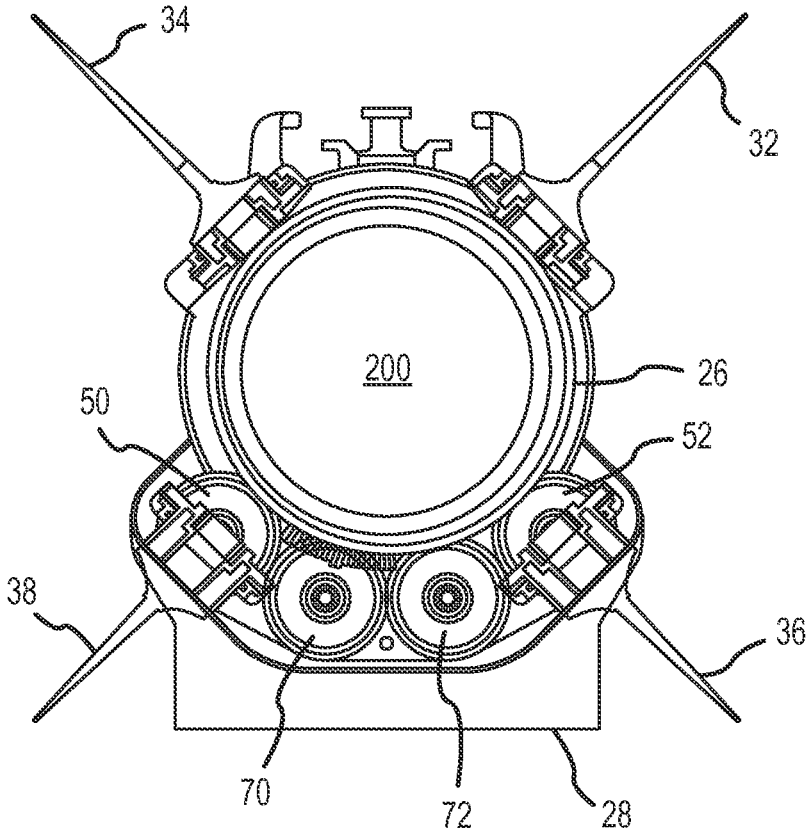
FIGS. 5*a* and 5*b* are end and section views of the tail section of the air-breathing missile.
Figure 5B:
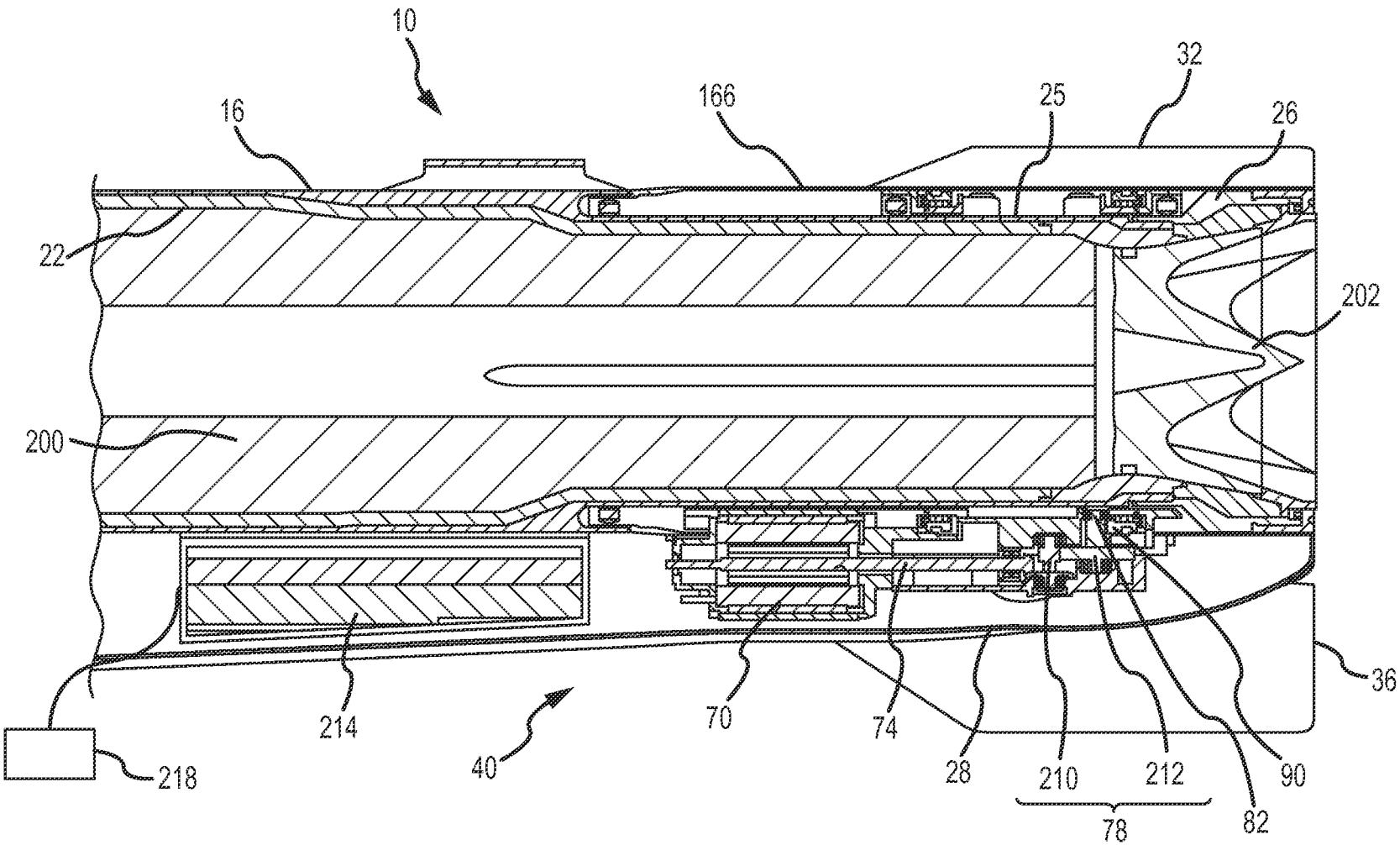

As shown in FIGS. 5*a* and 5*b* of the tail section of guided missile 10, ring gear CAS 40 is positioned around exhaust tube 25 and bolted to the rocket motor 16. Ramjet nozzle 26 is threaded on to the aft section of exhaust tube 25. Inlet fairing 28 is bolted to the missile airframe and extends aft from the air inlet to the tail of the missile. Tail fin 36 extends from inlet fairing 28 (fin 36 is suitably shortened to accommodate the inlet fairing). Tail fin 32 extends from the tail of the missile opposite the inlet fairing. As previously mentioned, ramjet combustion chamber 22 is initially provided with solid booster propellant 200 and ejectable booster nozzle 202 inside ramjet nozzle 26. At launch booster propellant 200 is ignited and burns until gone to produce thrust through booster nozzle 202 to bring the missile to a sufficient speed for the ramjet to takeover at which point booster nozzle 202 is jettisoned.

Ring gear CAS 40 fits in the small annular region around exhaust tube 25 and within the volume defined by inlet fairing 28 so that the CAS' skin 166 has approximately the same diameter (cross section) as the missile airframe. The drive motors 50, 70, 72 and 52 and their gear assemblies reside towards the tail of inlet fairing 28. As shown drive motor 70 rotates drive shaft 74, which in turn rotates input gear train 78 (e.g. compound gears 210, 212) to rotate input gear 82. Input gear 82 engages ring gear 90 causing the ring gear to rotate around exhaust tube 25 in a circumferential direction of the missile to rotate the output gear (not shown) to pivot tail fin 32. Ring gear CAS 40 also includes electronics 214 and batteries (not shown) positioned forward in inlet fairing 28 and a wiring harness 218 to connect to a missile wiring harness.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A control actuation system (CAS) for actuating tail fins on an air-breathing missile, said missile comprising a first air inlet to draw air to a rocket motor that expels gases through an exhaust tube to propel the missile and a first streamlined inlet fairing extending aft of the first air inlet towards the tail of the missile, said CAS comprising:

a first remote actuation assembly, comprising:

a first motor positioned external to said exhaust tube within the first inlet fairing, said first motor rotating a drive shaft;

a first input gear positioned external to said exhaust tube within the first inlet fairing, said first input gear mechanically coupled to the drive shaft to rotate the first input gear about an input axis;

a first output gear positioned coincident with and mechanically coupled to a first tail fin to rotate the fin, said first output gear and first tail fin offset in a circumferential direction of the missile from said first input gear and the inlet fairing; and a first ring gear positioned around the exhaust tube to rotate in the circumferential direction of the missile, said first ring gear comprising input teeth that engage the first input gear and output teeth that engage the first output gear to rotate the output gear and remotely actuate said first tail fin.

2. The CAS of claim 1, wherein the rocket motor comprises a ramjet.

3. The CAS of claim 1, wherein the first ring gear is part of a ring gear subassembly that further comprises:

at least one bearing to support the ring gear against lateral, axial, and moment loads.

4. The CAS of claim 1, wherein the remote actuation assembly delivers a constant gear ratio to actuate the fin over a range of motion.

5. The CAS of claim 1, wherein said ring gear's input and output teeth are different to mate with the different input and output gears.

6. The CAS of claim 1, wherein the input gear's input axis and the output gear's axis of rotation are oriented radially with respect to the first ring gear.

7. The CAS of claim 1, further comprising an input gear train comprising at least one compound gear that mechanically couples the motor's drive shaft to the input gear.

8. The CAS of claim 1, further comprising a second remote actuation assembly configured substantially as said first remote actuation assembly to actuate a second tail fin offset in the circumferential direction of the missile from said first tail fin and the inlet fairing.

9. The CAS of claim 8, wherein said missile comprises only said first air inlet and said first streamlined inlet fairing, wherein the motor and input gear for said first and second remote actuation assemblies are both positioned within said first air inlet.

10. The CAS of claim 9, further comprising first and second direct actuation assemblies for actuating third and fourth tail fins offset in the circumferential direction from each other and coincident with the said first inlet fairing, each direct actuation assembly comprising:

a first motor positioned external to said exhaust tube within the first inlet fairing, said first motor rotating a drive shaft;

a first input gear positioned external to said exhaust tube within the first inlet fairing, said first input gear mechanically coupled to the drive shaft to rotate the first input gear about an input axis; and a first output gear positioned external to said exhaust tube within and extending through the first inlet fairing to rotate the fin, said first output gear engaging said first input gear to actuate the fin.

11. The CAS of claim 8, wherein said missile comprises a second air inlet and second streamlined inlet fairing offset in a circumferential direction of the missile from the first air inlet and first streamlined inlet fairing, wherein the motor and input gear for said first and second remote actuation assemblies are positioned within said first and second inlet fairings, respectively.

12. The CAS of claim 11, further comprising first and second direct actuation assemblies for actuating third and fourth tail fins offset in the circumferential direction from each other and coincident with the said first and second inlet fairings, respectively, each direct actuation assembly comprising:

a first motor positioned external to said exhaust tube within its inlet fairing, said first motor rotating a drive shaft;

a first input gear positioned external to said exhaust tube within its inlet fairing, said first input gear mechanically coupled to the drive shaft to rotate the first input gear about an input axis; and a first output gear positioned external to said exhaust tube within and extending through its inlet fairing to rotate the fin, said first output gear engaging said first input gear to actuate the fin.

13. An air-breathing guided missile, comprising:

a missile airframe;

an air-breathing rocket motor within the airframe a first air inlet external to the missile airframe to draw air into the rocket motor to combust with rocket fuel and produce exhaust gases;

an exhaust tube extending aft of the rocket motor to expel exhaust gases to propel the missile;

a first streamlined inlet fairing extending aft of the first air inlet towards the tail of the missile;

a first tail fin offset in a circumferential direction of the missile from the air inlet; and a control actuation system (CAS) comprising a first remote assembly to actuate the first tail fin, said first remote assembly comprising, a first motor positioned external to said exhaust tube within the first inlet fairing, said first motor rotating a drive shaft;

a first input gear positioned external to said exhaust tube within the first inlet fairing, said first input gear mechanically coupled to the drive shaft to rotate the first input gear about an input axis;

a first output gear positioned coincident with and mechanically coupled to the first tail fin to rotate the fin, said first output gear and first tail fin offset in a circumferential direction of the missile from said first input gear and the inlet fairing; and a first ring gear positioned around the exhaust tube to rotate in the circumferential direction of the missile, said first ring gear comprising input teeth that engage the first input gear and output teeth that engage the first output gear to rotate the output gear and remotely actuate said first tail fin.

14. The guided missile of claim 13, further comprising a second remote actuation assembly configured substantially as said first remote actuation assembly to actuate a second tail fin offset in the circumferential direction of the missile from said first tail fin and the first inlet fairing, wherein the motor and input gear for said first and second remote actuation assemblies are both positioned within said first air inlet.

15. The guided missile of claim 13, further comprising a first direct actuation assemblies for actuating a second tail fin coincident with the said first inlet fairing, said first direct actuation assembly comprising:

a first motor positioned external to said exhaust tube within the first inlet fairing, said first motor rotating a drive shaft;

a first input gear positioned external to said exhaust tube within the first inlet fairing, said first input gear mechanically coupled to the drive shaft to rotate the first input gear about an input axis; and a first output gear positioned external to said exhaust tube within and extending through the first inlet fairing to rotate the second tail fin, said first output gear engaging said first input gear to actuate the fin.

16. The guided missile of claim 13, wherein said missile comprises a second air inlet and second streamlined inlet fairing offset in a circumferential direction of the missile from the first air inlet and first streamlined inlet fairing, said CAS further comprising a second remote actuation assembly configured substantially as said first remote actuation assembly to actuate a second tail fin offset in the circumferential direction of the missile from said first tail fin and the second inlet fairing, wherein the motor and input gear for said second remote actuation assembly are both positioned within said second inlet fairing.

17. An air-breathing guided missile, comprising:

a missile airframe;

an air-breathing rocket motor within the airframe a first air inlet external to the missile airframe to draw air into the rocket motor to combust with rocket fuel and produce exhaust gases;

an exhaust tube extending aft of the rocket motor to expel exhaust gases to propel the missile;

a first streamlined inlet fairing extending aft of the first air inlet towards the tail of the missile;

first, second, third and fourth tail fins spaced circumferentially about the missile, said first and second tail fins offset in a circumferential direction of the missile from the inlet fairing, said third and fourth tail fins coincident with the inlet fairing; and a control actuation system (CAS) comprising, first, second, third and fourth motors positioned external to said exhaust tube within the first inlet fairing, each said motor rotating a drive shaft;

first, second, third and fourth input gears positioned external to said exhaust tube within the first inlet fairing, said input gears mechanically coupled to the respective drive shaft to rotate the input gears about respective input axes;

first, second, third and fourth output gears positioned coincident with and mechanically coupled to the first, second, third and fourth tail fin to rotate the fins, said third and fourth output gears mechanically coupled to said third and fourth input gears for direct actuation of said third and fourth fins; and first and second ring gears positioned around the exhaust tube to rotate in the circumferential direction of the missile, said first and second ring gear comprising input teeth that engage the first and second input gears, respectively and output teeth that engage the first and second output gears, respectively, to rotate the first and second output gear sand remotely actuate said first and second tail fins.

18. The guided missile of claim 17, wherein the rocket motor comprises a ramjet.

19. The guided missile of claim 17, wherein the first ring gear is part of a ring gear subassembly that further comprises:

at least one bearing to support the ring gear against lateral, axial, and moment loads.

20. The guided missile of claim 17, wherein the CAS delivers a constant gear ratio to actuate the fins over a range of motion.

* * * * *